United States Patent [19]

Pogoda

[11] 4,320,689

[45] Mar. 23, 1982

[54] COMBINED PICK AND TUNER

[76] Inventor: Gary S. Pogoda, 223 N. Douglass Ave., Margate, N.J. 08402

[21] Appl. No.: 120,061

[22] Filed: Feb. 11, 1980

[51] Int. Cl.[3] ..... G10G 7/02

[52] U.S. Cl. ..... 84/454; 84/320; 84/322; 84/DIG. 18

[58] Field of Search ..... 84/453, 454, 455, 457, 84/DIG. 18, 200, 312 R, 320, 322, 169

[56] References Cited

U.S. PATENT DOCUMENTS

| | | | |
|---|---|---|---|
| 3,183,761 | 5/1965 | Van Ooyen | 84/454 |
| 3,501,992 | 3/1970 | Osborn et al. | 84/454 |
| 3,795,169 | 3/1974 | Belcher | 84/454 |
| 4,061,071 | 12/1977 | Cameron | 84/454 |

*Primary Examiner*—L. T. Hix
*Assistant Examiner*—S. D. Schreyer
*Attorney, Agent, or Firm*—Duffield & Lehrer

[57] ABSTRACT

A combined pick and stringed instrument tuning device includes a relatively flat, substantially rectangularly shaped housing having a pick attached thereto and is small enough to be easily held in one's hand. A momentary contact push-button switch mounted on top of the housing controls an electronic tuning circuit by selecting one of several predetermined frequencies from a frequency generator. In one embodiment, the tuning circuit is mounted in the housing so that the tuning device is totally self-contained. Alternatively, the tuning circuit is remotely located and is controlled by a cable connected to the housing or by radio signals. The frequency selected is displayed on the housing and the frequency generator drives a strobe light located near the pick. In another embodiment, a microphone mounted on the housing converts sounds from the string being tuned to a signal which is compared to the preselected frequency. One light on the housing indicates when the string frequency is too high and another indicates when it is too low.

18 Claims, 7 Drawing Figures

COMBINED PICK AND TUNER

BACKGROUND OF THE INVENTION

This invention is directed toward a combined pick and stringed instrument tuner and more particularly toward a tuning device which is small enough to be easily held in one's hand and which includes a pick at the end thereof so that the device may be used for playing a stringed instrument such as a guitar.

Numerous electronic tuning devices have been proposed over the years for aiding a musician in the tuning of a stringed instrument such as guitar. There are basically two types of tuning devices which have been proposed. The first is a stroboscopic tuner which basically includes a light source which turns on and off at a predetermined and preset frequency which frequency is equal to the frequency of the string to be tuned. When the strobe light is shined on the string, a wellknown stroboscopic movement is observed and as the string is brought into tune, movement stops and the string appears to be standing still. One such device is shown, for example, in U.S. Pat. No. 4,061,071.

The second type of electronic tuning devices which has been proposed includes a microphone or pickup for converting the sound produced by a vibrating string into an electronic signal. This signal is compared with a signal from a frequency generator which is selected to be equal to the frequency of the string being tuned. These various devices include numerous different techniques for indicating when the comparator senses that the frequency of the string is equal to the frequency of the frequency generator. Examples of this type of tuning device are shown in U.S. Pat. Nos. 3,766,818; 3,861,266 and 3,901,120.

While some of these devices are somewhat useful in tuning a stringed instrument, they all suffer from primarily the same problem. All of the prior proposed devices known to Applicant are difficult or at least inconvenient to operate particularly when a musician merely wishes to check the tuning of his instrument such as in between numbers. This is due to the fact that the musician utilizing the device must stop what he is doing, set the controls on the tuning device, adjust his instrument and then replace the strobe or microphone or the like.

SUMMARY OF THE INVENTION

The present invention overcomes the problems of the prior art devices described above and provides a stringed instrument tuning device which can easily and quickly be used by a musician. The device includes a relatively flat, substantially rectangularly shaped housing having a pick attached thereto and is small enough to be easily held in one's hand. A momentary contact push-button switch mounted on top of the housing controls an electronic tuning circuit by selecting one of several predetermined frequencies from a frequency generator. In one embodiment, the tuning circuit is mounted in the housing so that the tuning device is totally self-contained. Alternatively, the tuning circuit is remotely located and is controlled by a cable connected to the housing or by radio signals. The frequency selected is displayed on the housing and the frequency generator drives a strobe light located near the pick.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
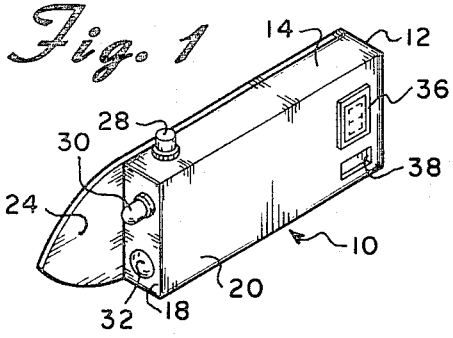
FIG. 1 is a perspective view of a combined pick and strnged instrument tuning device constructed in accordance with the principles of the present invention.

Referring now to the drawings in detail wherein like reference numerals have been used throughout the various figures to identify like elements, there is shown in FIG. 1 a combined pick and stringed instrument tuning device constructed in accordance with the principles of the present invention and designated generally at 10. The operative parts of the device are contained in or mounted on a substantially rectangularly shaped housing 12 having a top wall 14, a bottom wall 16, a forward end wall 18 and a front wall 20. This housing 12 is relatively small so that it can be easily held in the palm of one's hand. By way of example and not limitation, the housing 12 may be 1 inch high by 2 inches long by ½ inch deep.

Figure 3:
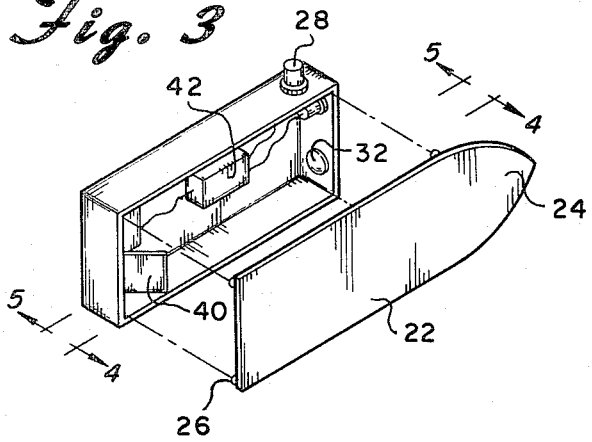
FIG. 3 is a rear perspective view of the device shown in FIG. 1 and showing the pick removed from the back.
Figure 4:
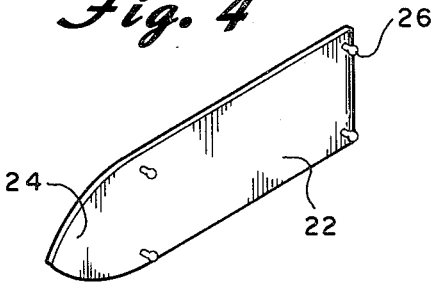
FIG. 4 is a perspective view of the inside surface of the pick taken from the line 4—4 of FIG. 3.
Figure 5:
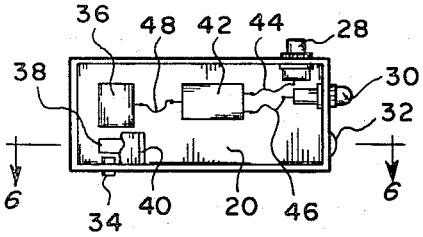
FIG. 5 is a cross-sectional view taken along the line 5—5 of FIG. 3.

As shown most clearly in FIG. 3, the back of the housing 12 is normally open. It is closed by a cover member 22 having a substantially rectangular shape similar to the shape of the front 20 but being slightly longer and terminating in a rounded rectangularly shaped forward portion 24. The inside surface of the back cover member 22 has a plurality of upstanding pins 26 which are intended to be forced fit into the corners of the housing 12 as shown in FIG. 3 so as to maintain the back cover 22 in place on the housing 12. With the cover 22 in place, the forward end 24 thereof extends forwardly of the housing 12 as shown in FIG. 1 and may be used as a pick for playing a musical stringed instrument such as a guitar or the like.

Mounted on the top wall 14 adjacent the forward end thereof is a switch means 28 which is responsive to a person's touch. For example, the switch means 28 may be a momentary contact push-button switch. A light emitting diode 30 which will function as a stroboscopic light source is mounted on wall 18 which is adjacent the pick 24. Below the diode or strobe light 30 is a lens 32. The lens 32 allows light impinging thereon to be directed into the interior of the housing 12.

Figure 2:
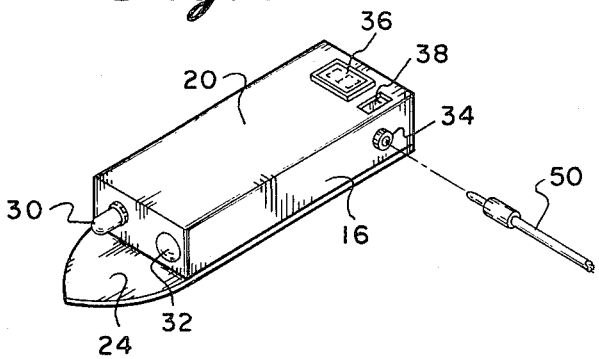
FIG. 2 is a perspective view of the device shown in FIG. 1 showing the bottom thereof.
Figure 6:
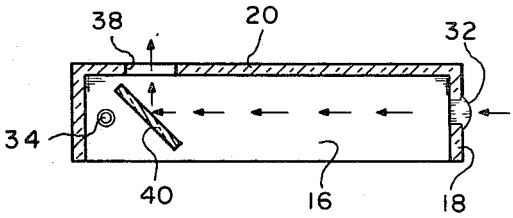
FIG. 6 is a cross-sectional view taken along the line 6—6 of FIG. 5.

A jack 34 is mounted on the bottom wall 16. On the front wall 20 is mounted a display 36 such as a seven-segment light emitting diode or the like. Beneath the display 36 is a window opening 38. As shown most clearly in FIG. 6, a mirror 40 is arranged within the housing 12 so that light entering through the lens 32 into the interior of the housing is reflected through the window opening or viewing window 38. An electronic tuner circuit 42 may also be mounted within the housing 12. Circuit 42 is connected to the switch 28 by wires 44, it is connected to the strobe light 30 by wires 46 and the circuit 42 is connected to the display 36 by appropriate cable 48. Alternatively, the electronic tuner circuit 42 may be mounted at some remote location. In this case, the various wires 44, 46 and 48 will be connected to jack 34 and appropriate cable 50 (FIG. 2) may be used to connect the switch 28, strobe light 30 and display 36 to the remotely located tuner circuit. In a still further embodiment, a miniature wireless transceiver may be mounted within the housing 12 and communications between the various operative components mounted on or in the housing may be accomplished by remote control. In this case, element 50 shown in FIG. 2 may function as an antenna and jack 34 may function as the antenna socket.

Figure 7:
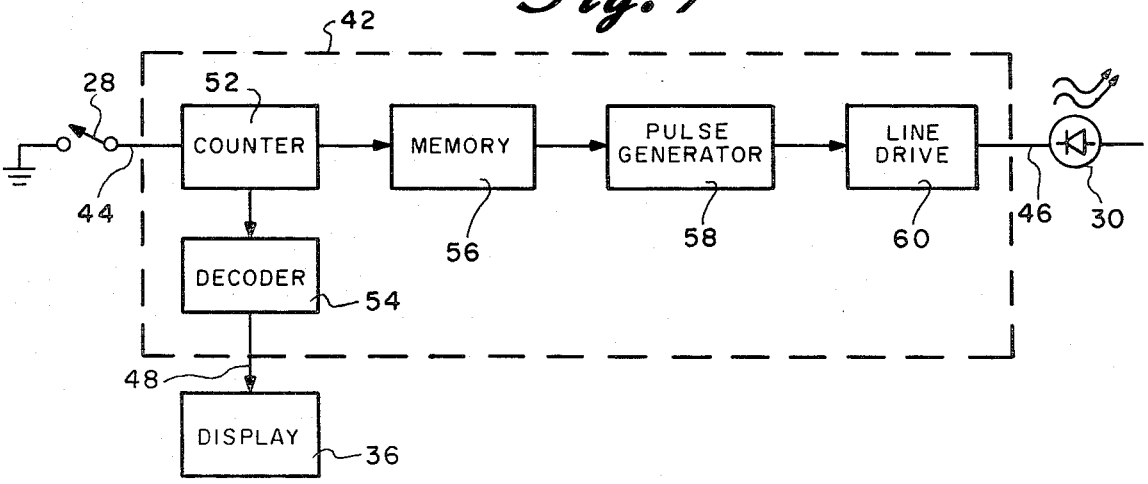
FIG. 7 is a schematic block representation of an electronic tuning circuit useful with the present invention.

An example of an electronic tuner circuit 42 which may be utilized with the present invention either in the form wherein the circuit 42 is located within the housing 12 or where it is remotely located is shown schematically in block diagram in FIG. 7. Circuit 42 is comprised of a counter 52 having its input connected to the push button 28. Each time the push button 28 is depressed, counter 52 is incremented. The count is decoded by decoder 54 which is connected to the seven-segment display 36. The display 36 will display, for example, one of the letters "E," "A," "D," "G" or "B," representing the strings of a guitar depending on the number of times that the push button 28 is depressed.

Counter 52 is also connected to a memory such as a ROM 56 which will then cause the pulse generator 58 to generate the appropriate frequency corresponding to the frequency of the string represented by the letter displayed by the display 36. The output of pulse generator 58 is connected to a line drive 60 which in turn is connected to the light emitting diode 30 which will then function as a strobe light at a frequency equal to that generated by the pulse generator 58.

The invention described above is utilized in the following manner. The device is preferably held in a person's hand with one's thumb on the front wall 20 and the index finger across the top wall. Push button 28 is depressed and this controls the tuner circuit 42 so as to select the desired string frequency. The selected string will be displayed on display 36 and strobe light 30 will strobe at the desired frequency. Utilizing the pick 24, a guitar string is then plucked and the strobe light 30 is held so as to shine on the vibrating string. The reflected light from the vibrating string will shine back through lens 32 and will be reflected by mirror 40 through the window opening 38 so as to be readily observed. In some instances it may be possible to observe the vibrating string directly but in many cases this is difficult to do and the optical system of the invention allows the illuminated vibrating string to be observed from a right angle. The tension on the string is then adjusted until the illuminated string appears to be standing still.

The present invention may be embodied in other specific forms without departing from the spirit or essential attributes thereof and accordingly, reference should be made to the appended claims rather than to the foregoing specification as indicating the scope of the invention.

I claim:

1. In a stringed musical instrument tuning device the improvement comprising:

a housing, said housing being of sufficiently small size so that it can be conveniently held in a person's hand and being intended to be so held when in use, a manually operable switch means carried by said housing, said switch means being adapted to control an electronic tuner circuit and being conveniently located so as to be operable while said housing is being held, a stroboscopic light source carried by said housing and being arranged to illuminate a vibrating string of a stringed musical instrument while said housing is being held, and a pick extending outwardly from one end of said housing, the free end of said pick being thin enough to fit between adjacent strings of a stringed musical instrument for plucking the same, said pick and light source being arranged with respect to each other so that the pick can be used to pluck the string to vibrate the same and the vibrating string can then be substantially immediately illuminated by said light source.

2. The device as claimed in claim 1 wherein said pick is substantially flat.

3. The device as claimed in claim 1 wherein said pick is removably attached to said housing.

4. The device as claimed in claim 1 wherein said switch means includes a means responsive to a person's touch.

5. The device as claimed in claim 4 wherein said switch means includes a push-button switch.

6. The device as claimed in claim 1 wherein said stroboscopic light source is mounted adjacent said pick.

7. The device as claimed in claim 1 wherein said stroboscopic light source includes a light emitting diode.

8. The device as claimed in claim 1 wherein said housing includes an optical system for viewing the portion of said string illuminated by said light source.

9. The device as claimed in claim 8 wherein said optical system includes a lens means.

10. The device as claimed in claim 8 wherein said optical system includes a mirror means.

11. The device as claimed in claim 8 wherein said optical system includes a viewing window oriented at an angle from said lens.

12. The device as claimed in claim 1 further including means carried by said housing for displaying information relating to the operation of said tuner circuit.

13. The device as claimed in claim 12 wherein said means for displaying is adapted to display the note designation of a preselected reference frequency.

14. The device as claimed in claim 13 wherein said switch means is adapted to select one of a plurality of reference frequencies from said tuner circuit.

15. The device as claimed in claim 1 further including an electronic tuner circuit located remote from said housing.

16. The device as claimed in claim 15 further including means for connecting the operable components associated with said housing to said tuner circuit.

17. The device as claimed in claim 15 further including radio circuit means for coupling the operable components associated with said housing to said tuner circuit.

18. The device as claimed in claim 1 further including an electronic tuner circuit mounted within said housing.

* * * * *